United States Patent [19]

Usui

[11] Patent Number: 4,971,014

[45] Date of Patent: Nov. 20, 1990

[54] FUEL DELIVERY RAIL ASSEMBLY

[75] Inventor: Masayoshi Usui, Numazu, Japan

[73] Assignee: Usui Kokusai Sangyo Kaisha Ltd., Shizuoka, Japan

[21] Appl. No.: 310,599

[22] Filed: Feb. 13, 1989

[30] Foreign Application Priority Data

Feb. 15, 1988 [JP] Japan ..... 63-17579[U]

[51] Int. Cl.[5] ..... F02M 39/00

[52] U.S. Cl. ..... 123/470; 123/468; 239/600; 239/551

[58] Field of Search ..... 123/470, 471, 472, 468, 123/469; 239/550, 551, 600, 397.5

[56] References Cited

U.S. PATENT DOCUMENTS

| | | | |
|---|---|---|---|
| 3,953,555 | 4/1976 | Gley | 239/550 |
| 4,286,563 | 9/1981 | Fahim et al. . | |
| 4,294,215 | 10/1981 | Hans | 123/470 |
| 4,457,280 | 7/1984 | Hudson, Jr. . | |
| 4,589,596 | 5/1986 | Stumpp | 239/397.5 |
| 4,647,012 | 3/1987 | Gartner | 123/470 |
| 4,697,611 | 10/1987 | Winland | 239/600 |
| 4,699,217 | 10/1987 | McLennan | 239/600 |

FOREIGN PATENT DOCUMENTS

| | | | |
|---|---|---|---|
| 3014066 | 10/1981 | Fed. Rep. of Germany | 123/470 |

*Primary Examiner*—Carl Stuart Miller
*Attorney, Agent, or Firm*—Wenderoth, Lind & Ponack

[57] ABSTRACT

A fuel delivery rail assembly for supplying fuel to a plurality of fuel injectors in an engine. The assembly includes an elongated conduit having a fuel passage therein and a plurality of sockets for making fluid communication between the conduit and the injectors. The socket comprises a metallic sheath adapted to be inserted into a socket positioning hole in the conduit and a plastic insert positioned within the metallic sheath. The metallic sheath and the plastic insert are combined by a mechanically shrinked edge of the sheath or an adhesive agent. The plastic insert may be nickel plated.

16 Claims, 2 Drawing Sheets

Fig. 1
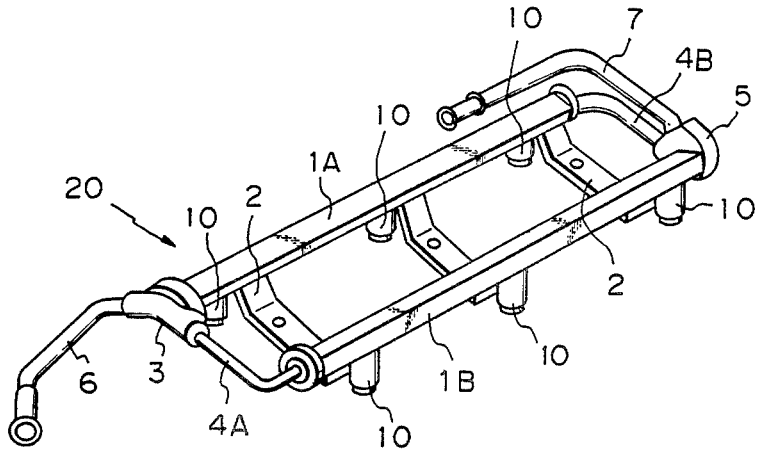
Fig. 4
PRIOR ART
Fig. 2
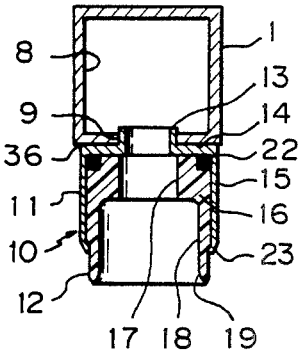
Fig. 3
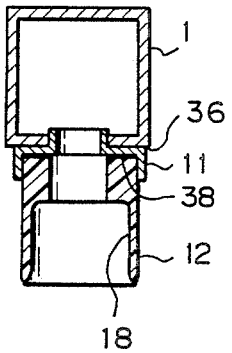
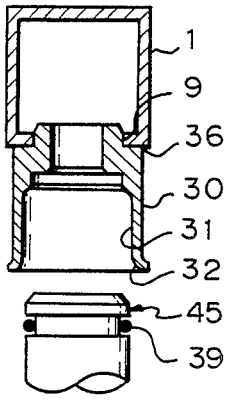

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

An example of V-type automotive engine equipped with a plurality of fuel injectors is shown in FIG. 5 of the drawings. In this engine, on each side of the crank shaft 40, three cylinders 41 and 42 are located intersecting at a V-shape angle. Toward the interior of intake manifolds 43 and 44, each forming a respective intake passage, pressurized fuel is discharged from fuel injectors 45 and 46. The fuel delivery rail assembly 50, which is the substantial matter of the present invention, comprises an elongated conduit 47 for supplying fuel toward the left-side three cylinders and an elongated conduit 48 for supplying fuel toward the right-side three cylinders 42, both conduits being interconnected for keeping fluid communication therethrough.

In a typical design of a V-6 engine, the fuel delivery rail assembly is constructed in the form as shown in FIG. 1 of the drawings. The fuel delivery rail assembly 20 comprises a pair of conduits 1A and 1B arranged in parallel fashion, both ends of which are interconnected via connecting pipes 4A and 4B. To each one of the conduits 1A and 1B, three sockets 10 are fixed complying with the predetermined mounting orientations so as to receive associated tips of fuel injectors. The axial directions of the sockets should precisely line up in alignment with the respective axial direction of the injectors. Furthermore, pitch lengths between adjacent sockets should precisely coincide with the corresponding pitch lengths between associated injectors. One of the objects of the present invention is directed to these alignment problems as discussed in detail below.

On one hand, at a connection between the connecting pipe 4A and the conduit 1A, a three-way joint 3 is fixed so as to receive a fuel inlet pipe 6, and on the other hand, at a connection between the connecting pipe 4B and the conduit 1B, a three-way joint 5 is fixed so as to receive a fuel return pipe 7.

To the pair of the conduits 1A and 1B, a plurality of thick and rigid brackets 2 are secured bridging the conduits for the purpose of enhancing the rigidity of the fuel delivery pipe assembly while also providing a stable installation to the engine.

In FIG. 4, an example of a conventional connection between a conduit and a socket in the prior art shown. The hollow section of the conduit 1 is generally formed in rectangular cross-section and to the bottom side of the conduit 1 a socket positioning hole 9 is provided. Within the positioning hole 9 a tip of a metallic integral socket 30 is inserted and fixed thereto by means of a brazing connection 36.

The metallic socket 30 is provided with a smooth interior surface 31 for receiving a tip of a fuel injector and an outwardly developing taper surface 32 adjacent its distal end. In particular, the interior surface 31 should be finished extremely smooth in order to establish a complete fluid seal between the surface 31 and a resilient O-ring 39, which is mounted on the injector 45 adapted to be inserted inside the surface 31. Therefore, in manufacturing the socket 30, many kinds of working steps are needed. For example, at first a rough fabrication is made by a forging work, and then it is machined to make a form of the interior surface 31. Finally, the socket is finished with a burnishing machine until the predetermined smoothness is obtained. Under the present situation, making the socket 30 entails many kinds of time-consuming working steps and transferring handling steps, resulting in increased manufacturing cost.

In U.S. Pat. No. 4,286,563 to Fahim et al., issued Sept. 1, 1981, there is disclosed a fuel rail for supplying fuel to a plurality of fuel injectors in a V-type engine. The sockets of the fuel rail are affixed directly to fuel rail means, thereby providing a unitary construction. This invention is directed to a swivel engagement for providing an adjustable alignment between the socket and the injector.

In U.S. Pat. No. 4,457,280 to Hudson, issued Jul. 3, 1984, there is disclosed a fuel injection rail assembly for holding a plurality of electromechanical fuel injector elements in aligned positions on an internal combustion engine. The beam portion of the fuel rail is comprised of two elongated manifold members with overlapping sides brazed together. As a result, the sockets are affixed directly to one of the manifold members. There is a disadvantage that this invention is limited to a simple-formed fuel rail assembly.

SUMMARY OF THE INVENTION

It is an object of the present invention to overcome the above difficulties in producing a fuel delivery rail assembly and to reduce the number of working steps.

Another object of the present invention is to provide an economical fuel delivery rail assembly.

Still another object of the present invention is to provide a lightweight fuel delivery rail assembly so as to reduce the resultant weight of an automotive engine.

According to the invention, there is provided a fuel delivery rail assembly for an internal combustion engine, the assembly including an elongated conduit having a fuel passage therein and a plurality of sockets attached perpendicularly to the conduit, one end of each of the sockets being inserted into a socket positioning hole arranged within the conduit while keeping fluid communication with the fuel passage, and the other end of each of the sockets being adapted to receive a tip of a fuel injector suitable for injecting fuel from its socket to a combustion chamber. Each of the sockets comprises a metallic sheath adapted to be inserted into the socket positioning hole, and a plastic insert adapted to be positioned within the metallic sheath, the metallic sheath and the plastic insert being combined by a mechanically shrinked edge of the sheath or by an adhesive agent.

Within the scope of the invention, each socket comprises a metallic sheath which bears an upper connection leading to a conduit and a plastic insert which bears a lower connection leading to a fuel injector. The metallic sheath, preferably made by a pressing machine from a metallic plate, is inserted into the socket positioning hole and then fixed to the conduit by means of brazing as in the conventional assembly. Other methods than brazing may be used to combine the sheath and the conduit. The plastic insert can be made to meet a required shape and surface smoothness through an injection molding process utilizing a metallic die, so that a smooth inside surface suitable for receiving a tip of a fuel injector can be accomplished easily, without the need of complicated forging and machining processes. Thus, the sealing property between the inside surface of the socket and the outer surface of the tip of the injector can be sufficiently accomplished.

With the results of the invention, since the socket is made of metallic and plastic materials in combination, its weight becomes relatively less than that of the conventional integral metallic socket. Thus, it can help to reduce the resultant weight of the fuel delivery rail assembly, thereby facilitating a reduction of engine weight.

As a further advantage of the present invention, the two piece type socket can provide a practical solution to the alignment problems between the socket and the injector, because flexibility remains in the axial direction of the socket due to the resiliency of the metallic sheath and the plastic insert.

In a preferable embodiment of the invention, the plastic insert is made from a glass-fiber reinforced polyamide resin and its surface is plated with nickel coating for the purpose of withstanding high temperature and gasoline fuel.

Other features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is a perspective view of the fuel delivery rail assembly according to the invention.

FIG. 2 is a vertical sectional view illustrating a connecting relationship between the conduit and one of the sockets.

FIG. 3 is a vertical sectional view illustrating an alternative embodiment of the connection between the conduit and the socket.

FIG. 4 is a vertical sectional view illustrating a conventional connection between the conduit and the socket.

DESCRIPTION OF THE PREFERRED EMBODIMENT

Figure 5:
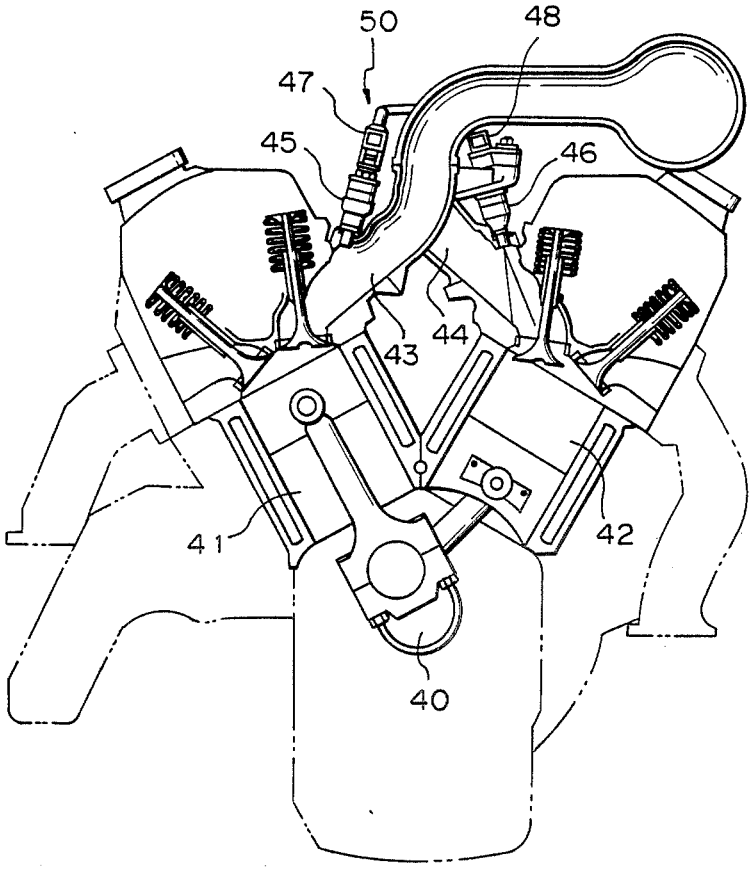
FIG. 5 is a schematic sectional view of a V-type engine, illustrating a mounting relationship between the fuel delivery rail assembly, injectors and intake manifolds.

Referring to FIG. 1, as stated above, there is shown a typical design of a fuel delivery rail assembly 20 for an automotive V-type engine. Although this assembly 20 is provided with an improved construction of the present invention, its outside appearance is nearly the same as that of the conventional one. It should be appreciated that the present invention is directed to an improved construction of the socket for receiving a tip of the fuel injector.

In FIG. 2, there is shown a sectional construction of a connection between a conduit 1 situated on one side of the fuel delivery rail assembly 20 and a socket 10 incorporating the characteristics of the present invention. Inside the conduit 1, which has a rectangular hollow section, a fuel supply passage 8 is defined, and within a socket positioning hole 9, which is one of the holes axially spaced along the longitudinal direction of the conduit 1, a socket 10 is inserted. Thus, one end of the socket 10 communicates with the inside of the fuel supply passage 8 and the other end of the socket 10 receives the tip of the fuel injector 45 (see FIG. 5).

The socket 10 comprises a metallic sheath 11 and a plastic insert 12. The sheath 11 includes a cylindrical head 13 adapted to be inserted into the socket positioning hole 9, a disk portion 14 horizontally extending from the bottom edge of the head 13, and a cylindrical skirt 15 downwardly extending from the periphery of the disk portion 14. The plastic insert 12 includes a stepped cylindrical body 16, a fuel passage 17 and an injector receiving interior surface 18, both defined centrally in the body 16, an outwardly developing taper surface 19, and a resilient O-ring 22 disposed between the body 16 and the associated sheath 11.

The metallic sheath 11 can be easily made by a pressing machine from a metallic plate, and the plastic insert 12 can be easily made into a single piece form through an injection molding process, utilizing a metallic mold from plastic material such as polyether-imide (PEI) resin or polyamide (PA) resin having properties of heat-resistance and fuel-resistance to a certain extent. Thus, the interior surface 18 is finished to obtain a required surface smoothness. While assembling the plastic insert 12 with the metallic sheath 11, the insert 12 carrying the associated O-ring 22 is inserted into the cylindrical skirt 15 of the sheath 11, and then the bottom edge 23 of the sheath 11 is mechanically shrinked over a ledge on insert 12 so as to fix the insert 12 thereto. Before the edge 23 is shrinked it is preferable to apply an adhesive agent to a gap between the outside surface of the body 16 and the edge 23.

The socket 10 is fixed to the conduit 1 by brazing the abutment portion 36 defined around the periphery of the disk portion 14 of the metallic sheath 11. Since the plastic insert 12 is enclosed within the sheath 11, its rigidity is reinforced and sealing properties are effectively maintained.

FIG. 3 shows an alternative embodiment of the socket for the present invention. In this embodiment, the metallic sheath 11 is shortened in order to reduce its weight, and to connecting portion 38 abutting with the plastic insert 12 has an adhesive agent of epoxy resin type applied thereto, which can provide connecting forces and also sealing properties therebetween.

Further alternatively, it is most desirable to make the plastic insert 12 from a glass fiber reinforced polyamide resin and to apply a nickel coating to the surface thereof. As a result of the specially prepared plastic material and the nickel coating, the socket 10 can withstand the high temperature of the engine and exposure to a gasoline fuel. According to the embodiment shown in FIG. 3, the weight of the socket is further reduced, whereby it becomes more economical.

Thus, as is apparent from the above description, the fuel delivery rail assembly of the invention can provide technical advantages as follows:

(1) Since many kinds of working and transferring steps can be saved, the fuel delivery rail assembly becomes economical and easy to manufacture.

(2) Since a portion of the prior art metallic socket is replaced with a plastic portion, the weight of the assembly is reduced, so that the resultant weight of the engine becomes lighter.

(3) Since there remains a flexibility in the axial direction of the socket due to the resiliency of the metallic sheath and the plastic insert, it becomes possible to make a practical adjustment for the alignment between the socket and the injector.

I claim:

1. A fuel delivery rail assembly for an internal combustion engine, comprising:

at least one elongated conduit forming a fuel passage therein;

a plurality of socket positioning holes extending into said elongated conduit;

a plurality of metallic socket sheaths, each of said sheaths being mounted in an associated one of said holes in fluid communication with said fluid passage; and a plurality of non-metallic socket inserts, each of said inserts being mounted within an associated one of said sheaths and being in fluid communication with said fluid passage, and each of said inserts being adapted to fully receive an associated fuel injector nozzle.

2. An assembly as in claim 1, wherein said non-metallic socket inserts are formed of glass fiber reinforced polyamide resin, and further comprising nickel plating on the surface of said socket inserts.

3. A fuel delivery rail assembly for an internal combustion engine, comprising:

at least one elongated conduit forming a fuel passage therein;

a plurality of socket positioning holes extending into said elongated conduit;

a plurality of metallic socket sheaths, each of said sheaths being mounted in an associated one of said holes in fluid communication with said fluid passage; and a plurality of non-metallic socket inserts, each of said inserts being connected to an associated one of said sheaths and being in fluid communication with said fluid passage, each of said inserts extending outwardly from said conduit and beyond said associated sheath, and each of said inserts being adapted to receive an associated fuel injector nozzle.

4. An assembly as in claim 3, wherein said non-metallic socket inserts are formed of glass fiber reinforced polyamide resin, and further comprising nickel plating on the surface of said socket inserts.

5. An assembly as in claim 3, wherein each of said inserts is connected to said associated one of said sheaths by adhesive.

6. An assembly as in claim 5, wherein said non-metallic socket inserts are formed of glass fiber reinforced polyamide resin, and further comprising nickel plating on the surface of said socket inserts.

7. An assembly as in claim 5, wherein each of said sheaths includes a skirt extending outwardly from said conduit, each of said skirts encompassing a portion of an outer peripheral surface of said associated one of said inserts.

8. An assembly as in claim 7, wherein said non-metallic socket inserts are formed of glass fiber reinforced polyamide resin, and further comprising nickel plating on the surface of said socket inserts.

9. An assembly as in claim 3, wherein each of said sheaths includes a skirt extending outwardly from said conduit, each of said skirts encompassing a portion of an outer peripheral surface of said associated one of said inserts and having an area of mechanically reduced periphery creating mechanical interference with said associated one of said inserts, said mechanical interference connecting each said sheath to said associated one said inserts.

10. An assembly as in claim 9, wherein said non-metallic socket inserts are formed of glass fiber reinforced polyamide resin, and further comprising nickel plating on the surface of said socket inserts.

11. An assembly as in claim 9, wherein each of said inserts includes a peripheral groove in said portion of said outer peripheral surface, and further comprising an O-ring mounted in each said groove, each said O-ring providing a fluid seal between each said sheath and said associated one of said inserts.

12. An assembly as in claim 11, wherein said non-metallic socket inserts are formed of glass fiber reinforced polyamide resin, and further comprising nickel plating on the surface of said socket inserts.

13. An assembly as in claim 9, wherein each of said inserts includes a peripheral ledge in said portion of said outer peripheral surface, said ledge having a reduced periphery in a direction in which each respective said insert extends, and wherein each of said areas of mechanically reduced periphery is a free end and said mechanical interference is created with each associated one of said ledges.

14. An assembly as in claim 13, wherein said non-metallic socket inserts are formed of glass fiber reinforced polyamide resin, and further comprising nickel plating on the surface of said socket inserts.

15. An assembly as in claim 13, wherein each of said inserts includes a peripheral groove in said portion of said outer peripheral surface, said groove being inward of said ledge in said direction, and further comprising an O-ring mounted in each said groove, each said O-ring providing a fluid seal between each said sheath and said associated one of said inserts.

16. An assembly as in claim 15, wherein said non-metallic socket inserts are formed of glass fiber reinforced polyamide resin, and further comprising nickel plating on the surface of said socket inserts.

* * * * *